US012751548B2

(12) United States Patent
Vang et al.

(10) Patent No.: US 12,751,548 B2
(45) Date of Patent: Oct. 6, 2026

(54) CHAIR WITH SENSORY FEATURE

(71) Applicant: KRUEGER INTERNATIONAL, INC., Green Bay, WI (US)

(72) Inventors: Xeng Xue Vang, Green Bay, WI (US); Scott A. Bosman, Green Bay, WI (US); Timothy J. Bouche, Green Bay, WI (US); Kyle Boudreau, De Pere, WI (US); Michael Lah, Green Bay, WI (US)

(73) Assignee: KRUEGER INTERNATIONAL, INC., Green Bay, WI (US)

( * ) Notice: Subject to any disclaimer, the term of this patent is extended or adjusted under 35 U.S.C. 154(b) by 101 days.

(21) Appl. No.: 18/894,337

(22) Filed: Sep. 24, 2024

(65) Prior Publication Data

US 2026/0083248 A1 Mar. 26, 2026

(51) Int. Cl.
*A47C 7/16* (2006.01)

(52) U.S. Cl.
CPC ..... *A47C 7/16* (2013.01)

(58) Field of Classification Search
CPC .... A47C 7/02; A47C 7/16; A47C 7/24; A47C 7/144; A47C 1/00
See application file for complete search history.

(56) References Cited

U.S. PATENT DOCUMENTS 5,904,402 A 5/1999 Sabo
6,003,946 A 12/1999 Jackson
9,282,822 B2 3/2016 Hogue
10,085,562 B1 * 10/2018 Labrosse ..... G05B 19/406
10,272,282 B2 * 4/2019 Harlow ..... A47C 7/746
10,667,612 B2 * 6/2020 Matlin ..... A47C 7/38
10,813,806 B2 * 10/2020 Paul ..... A61G 5/1013
10,898,134 B2 1/2021 Smith
11,369,203 B2 * 6/2022 Mazlish ..... A47C 7/46
(Continued)

FOREIGN PATENT DOCUMENTS

DE 112019007468 T5 2/2022
GB 191221920 A 2/1913
WO 2012145463 A1 10/2012

OTHER PUBLICATIONS

Jumper Air Active Forward-flexing cantilever office chair. VS America. Brochure dated Jun. 23, 2023.
(Continued)

*Primary Examiner* — Chi Q Nguyen
(74) *Attorney, Agent, or Firm* — Andrus Intellectual Property Law, LLP

(57) ABSTRACT

A chair for supporting a seat occupant that includes a sensory feature that allows the seat occupant to fidget when seated. The chair includes a seat shroud that is located below the seat and seating surface of the chair. The seat shroud includes a sensory feature that is located along at least a portion of the seat shroud. The sensory feature can include a plurality of raised surfaces, such as sensory domes or dots, distributed along all or a portion of the front surface and side surfaces of the seat shroud. The size of the sensory domes can vary, and the different sized sensory domes can be randomly distributed along the surfaces of the seat shroud. When seated, the seat occupant can reach below the seat and engage the sensory feature to allow the seat occupant to fidget and divert their attention.

19 Claims, 5 Drawing Sheets

(56) References Cited

U.S. PATENT DOCUMENTS

| | | | | |
|---|---|---|---|---|
| 2004/0056520 | A1* | 3/2004 | Cho | A47C 7/72 297/218.1 |
| 2014/0031609 | A1 | 1/2014 | Ballard | |
| 2014/0316465 | A1* | 10/2014 | Robinson | A47C 7/705 606/242 |
| 2015/0273178 | A1 | 10/2015 | Johnson | |
| 2016/0088948 | A1* | 3/2016 | Boduk | A47C 31/126 297/217.2 |
| 2016/0257612 | A1* | 9/2016 | de Paor | C03B 19/066 |
| 2016/0360889 | A1* | 12/2016 | Matlin | A47C 3/0257 |
| 2023/0218085 | A1* | 7/2023 | Sugiyama | B60N 2/0033 297/217.2 |
| 2023/0249599 | A1* | 8/2023 | Nicola | B60N 2/0244 297/284.6 |
| 2023/0322129 | A1* | 10/2023 | Mizoi | G01B 17/00 297/217.2 |

OTHER PUBLICATIONS

PantoSwing-LuPo Forward-flexing cantilever chair—the ergonomic seating solution. VS America. Brochure dated Mar. 16, 2018.

Trideer Glossy Inflated Wobble Cushion. Accessed from https://trideer.com/products/trideer-glossy-inflated-wobble-cushion-wiggle-seat-for-sensory-kids-13-4-inches?variant=43467139580070 on Sep. 23, 2024.

Bouncyband Wiggle Seat Big Portable Sensory Chair Cushion. Accessed from https://bouncyband. com/products/portable-wiggle-seat-sensory-cushion on Sep. 23, 2024.

Velcro Fidget Strips. Accessed from https://therapyshoppe.com/category/P3009-velvro-fidget-strips-classroom-focus-ot-sensory-tool-fidget-figit-toy-quiet-silent-figet on Jul. 16, 2024.

Extended European Search Report for EP Application No. 24211912.1, mailed Apr. 7, 2025.

* cited by examiner

CHAIR WITH SENSORY FEATURE

BACKGROUND

The present disclosure generally relates to a chair that includes a sensory feature that can be used by a seat occupant to fidget when seated. More specifically, the present disclosure is directed to a chair that includes sensory domes that are located below the seat of a chair such that the sensory domes can be engaged by the seat occupant when seated.

Autism spectrum disorder (ASD) is a neurological disorder characterized by symptoms including impaired social interaction, poor verbal and non-verbal communication skills, and restricted and repetitive behavior. It is believed that autism affects how information is processed in the brain by altering how nerve cells and their synapses connect and organize.

ASD individuals often have difficulty maintaining homeostasis within the nervous system, thereby inhibiting their ability to participate in effective learning and sometimes causing behaviors inconsistent with social norms. Such identifiable behaviors may include constant movement, impulsivity, decreased attention span, inability to focus on a particular task and seeking of heavy-pressure related tasks. Such behavior often occurs in crowded environments or uncomfortable situations, such as in a classroom environment.

Many ASD individuals find sensory input as an effective means to calm themselves. In order to minimize negative behavior and "meltdowns," both the ASD individual and an available caregiver attempt to have some type of sensory input items on hand at all times. This can often be achieved by carrying the preferred sensory input items in a pocketbook, a backpack or a carry bag. Unfortunately, in many instances, at the exact time that a sensory input item is needed most, the ASD individual and/or a caregiver may realize that they may not have the preferred sensory input item near the individual.

Sensory dots or domes, like other sensory tools, can help individuals with autism manage sensory overload. As stated, sensory overload can occur when an individual with autism encounters an excessive amount of sensory information that their brain struggles to process effectively. This can lead to discomfort, pain, headaches, or emotional distress such as anxiety and irritability. Sensory dots or domes provide a tactile stimulus that can help individuals focus and self-soothe, reducing the impact of sensory overload.

There have been efforts directed to ensuring that sensory input items remain available for use at all times. For example, U.S. Patent Application Publication No. 2015/0273178 to Johnson discloses clothing having on-board fidgets and texture areas attached to the clothing in order to alleviate the symptoms of neurological dysfunction, reduce stress, and provide an avenue for relief and comfort for individuals who respond to sensory information differently. The on-board fidgets can include texture areas, chewing areas, vibrating inserts, weights, olfactory, auditory, and touch stimuli. The on-board fidgets are designed to be discrete so that individuals may use and enjoy them without feeling awkward or different.

The inventors of the present disclosure recognized the need to have a sensory input item or feature near the ASD individual in as many locations as possible and that a classroom environment may be one location where the ASD individual would most benefit from such sensory item or feature. Since a classroom chair is present is most if not all classrooms, the inventors have contemplated including a sensory feature, such as sensory domes, on the classroom chair such that it would be accessible during most if not all of the times that an individual is in the classroom.

SUMMARY

The present disclosure relates to a chair that includes a sensory feature that can be used by a seat occupant to fidget when seated. More specifically, the present disclosure is directed to a chair that includes sensory domes that are located below the seat of a chair such that the sensory domes can be engaged by the seat occupant when seated.

The chair of the present disclosure includes a seat and a chair back that are each designed to support the seat occupant in a seated position. A seat shroud is positioned beneath the seat to create a desirable appearance for the chair. In one exemplary embodiment, both the seat and the shroud are formed from a molded plastic material. The seat shroud includes a front surface and a pair of spaced side surfaces that are each located below the seat when the chair is in an assembled, use condition.

The chair of the present disclosure includes a sensory feature that is located along at least a portion of the seat shroud. When the seat occupant is seated on the chair, the seat occupant can engage the sensory feature and thus fidget when seated. In one exemplary embodiment, the sensory feature is a plurality of raised surfaces that extend from the outer surface of the seat shroud. The raised surfaces can be partial round domes that form sensory domes on the seat shroud. The size of the sensory domes can vary on the seat shroud and the different sized sensory domes can be distributed on the different surfaces of the seat shroud. In one exemplary embodiment, sensory domes of a small size or sizes are included on the front surface and sensory domes of a larger size or sizes are included on the side surfaces of the seat shroud. The variation in the sizes of the sensory domes increases the sensory input to the seat occupant as compared to sensory domes of all the same size.

In one exemplary embodiment, the chair includes a leg assembly and the seat shroud and the seat entrap the leg assembly between the seat and the seat shroud. The seat shroud includes the sensory feature along at least a portion of the front surface and the side surfaces of the seat shroud.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
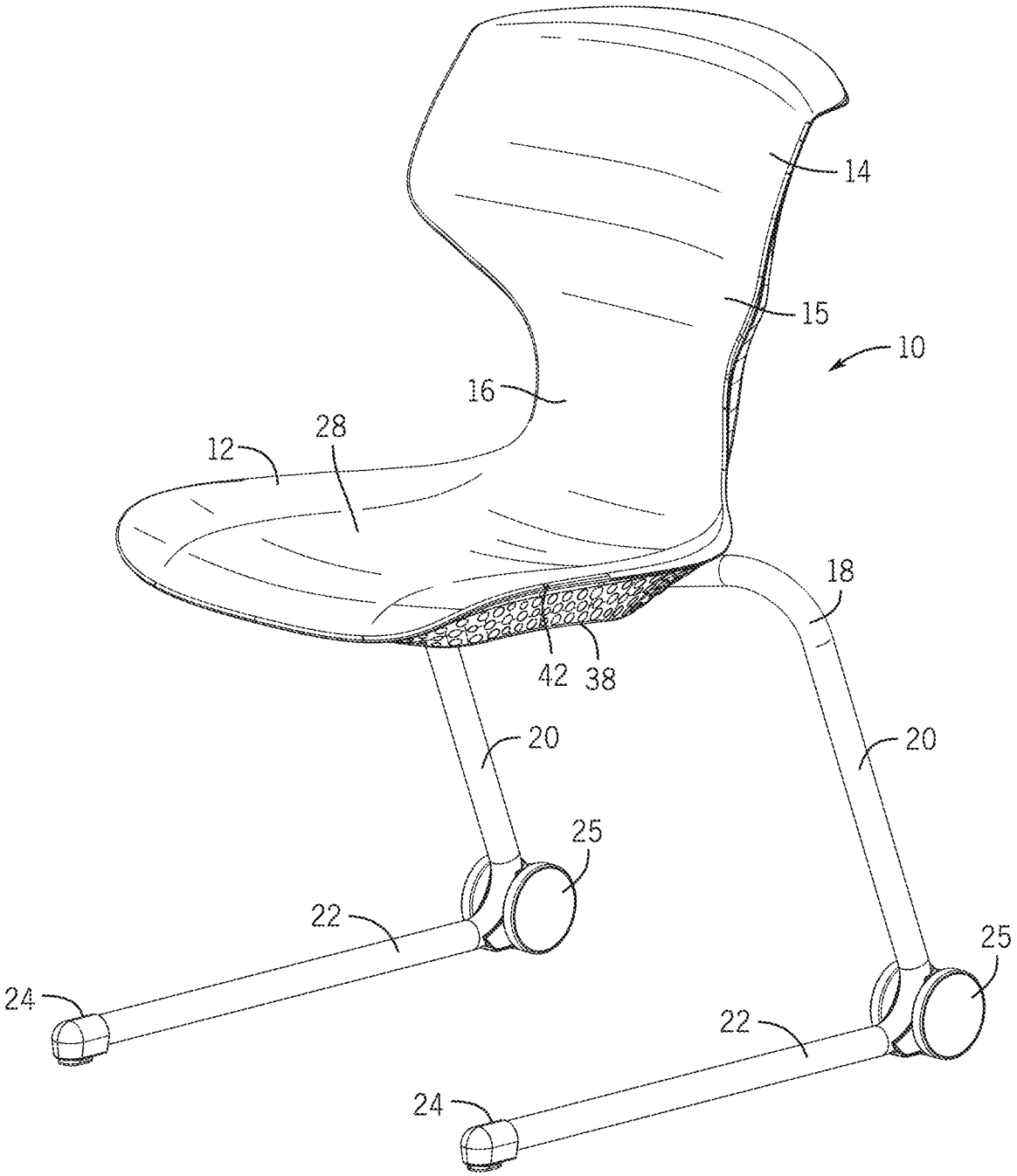
FIG. 1 is a front perspective view of a chair including the sensory feature of the present disclosure.

FIG. 1 illustrates a chair 10 constructed in accordance with the present disclosure. The chair 10 is designed to support a seat occupant in a comfortable position and is designed for use in many different environments. As an illustrative example, the chair 10 shown in FIG. 1 is designed for use in a classroom environment, although other locations are contemplated as being within the scope of the present disclosure.

The chair 10 includes a seat 12 and a chair back 14 that are each designed to support the seat occupant when the seat occupant is seated in the chair 10. In the embodiment shown in FIG. 1, the seat 12 and the chair back 14 are joined to each other by a flexing zone 16 that allows the chair back 14 to flex rearward relative to the seat 12. The seat 12 and chair back 14 thus create a one-piece molded shell 15 that is formed from a molded plastic material. However, it is contemplated that the seat 12 and chair back 14 could be joined to each other in other ways or be formed as completely separate components while operating within the scope of the present disclosure.

In the embodiment shown in FIG. 1, the chair 10 includes a leg assembly 18 that is used to support the seat 12 above a support surface. The leg assembly 18 shown in embodiment of FIG. 1 includes a pair of spaced down tubes 20 that are each connected to a lateral support portion 22. The lateral support portion 22 supports the chair on the support surface. In the embodiment shown, each lateral support portion 22 includes a ground engaging pad 24. In the embodiment shown, the leg assembly includes a wheel assembly 25 located at the transition between the down tube 20 and the lateral support portion 22. The wheel assembly 25 could be eliminated in other embodiments. Although one type of leg assembly 18 is shown in the exemplary embodiment of FIG. 1, it should be understood that different types of leg assemblies 18 could be utilized while operating within the scope of the present disclosure. As an illustrative example, the leg assembly could be sled legs, four separate legs, a pedestal base or any other type of leg assembly that is known in the art.

Figure 2:
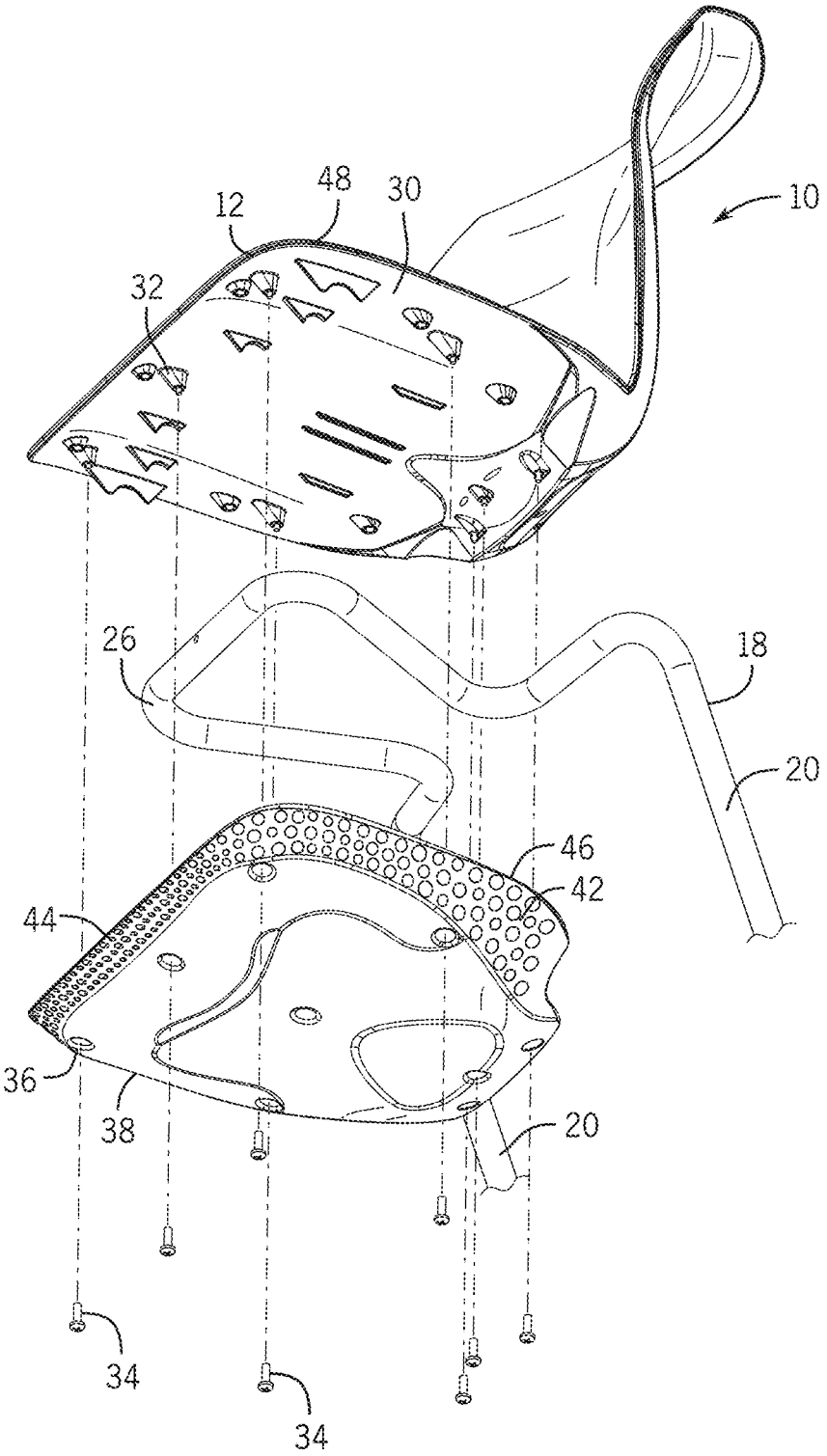
FIG. 2 is an exploded view showing the components of the chair of the present disclosure.

Referring now to the exploded view of FIG. 2, in the illustrated embodiment, the leg assembly 18 is formed from a continuous tube of material that extends between and defines the pair of down tubes 20 and further defines a chair support portion 26. The chair support portion 26 is designed to provide support for the seat 12 when the seat occupant is within the chair 10.

As can be seen in FIGS. 1 and 2, the seat 12 includes an upper seating surface 28 and a lower support surface 30. In the embodiment shown, the seat 12 is formed from a molded plastic material and includes a series of molded standoffs 32 that are each designed to receive one of a plurality of connectors 34. As shown in FIG. 2, each of the connectors 34 extends through an access opening 36 that is formed in a seat shroud 38. The seat shroud 38 is designed to cooperate with the seat 12 to entrap the chair support portion 26 of the leg assembly 18 between the seat 12 and the seat shroud 38. The seat shroud 38 is formed from a single piece of molded plastic material and is located below the seat 12 when the chair 10 is assembled as shown in FIG. 1. The plurality of connectors 34 are each received within one of the standoffs 32 such that the connectors 34 can securely and easily attach the seat shroud 38 to the seat 12. When the chair 10 is assembled as shown in FIG. 1, the seat shroud 38 conceals the portion of the leg assembly 18 that extends below the seat 12 in a well-known manner.

Although a leg assembly 18 is shown in the embodiments of FIGS. 1 and 2 as including only a pair of down tubes 20, it should be understood that the leg assembly 18 could be replaced by four separate legs that each independently contact the support surface or with a sled-type leg that includes a pair of down tubes on each side of the chair. Yet further, the leg assembly 18 could be a pedestal base or any other type of leg assembly that is well known in the art and used to support the seat 12 and chair back 14 above a support surface.

Figure 3:
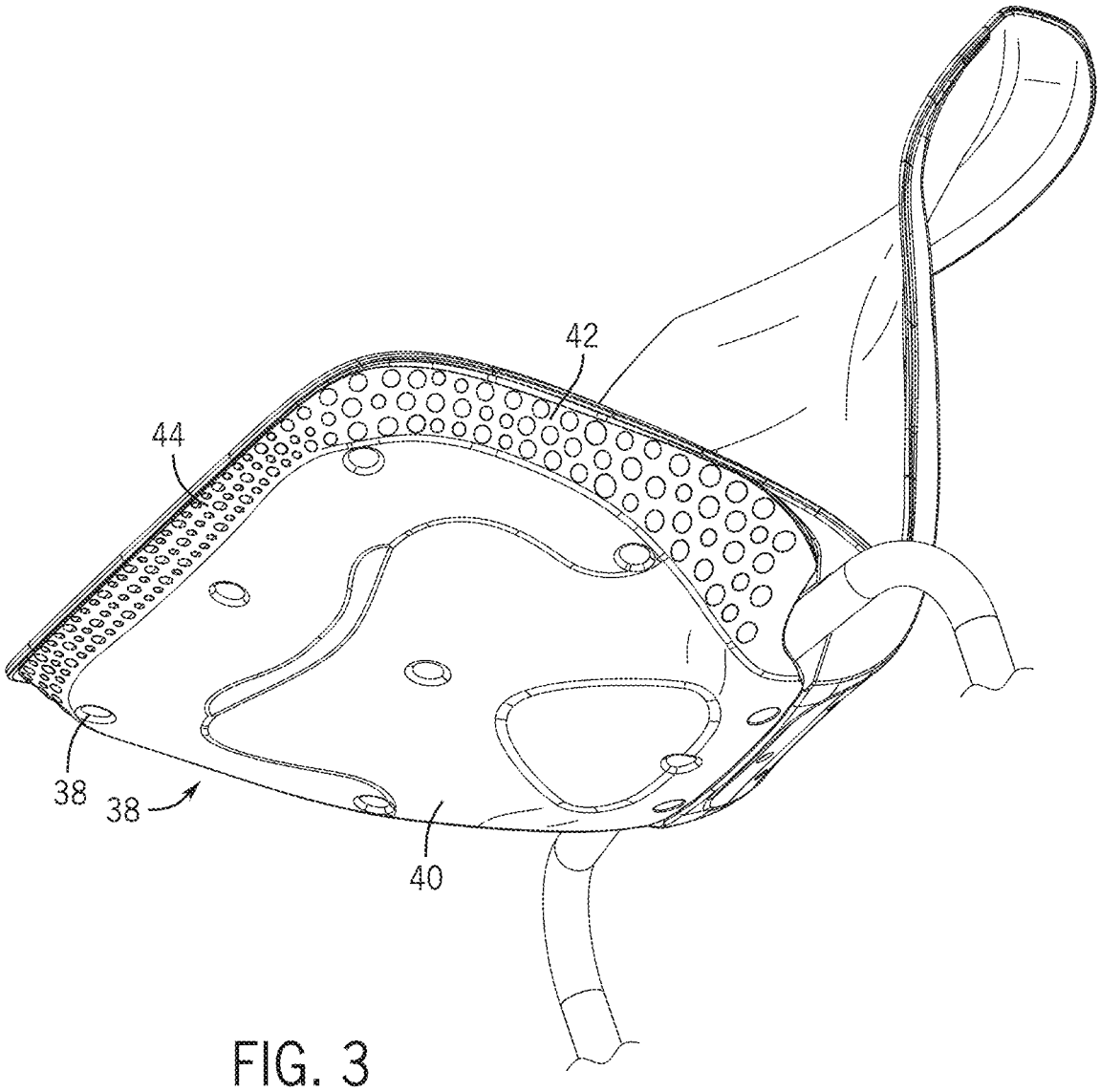
FIG. 3 is a bottom perspective view of the seat shroud including the sensory feature.
Figure 4:
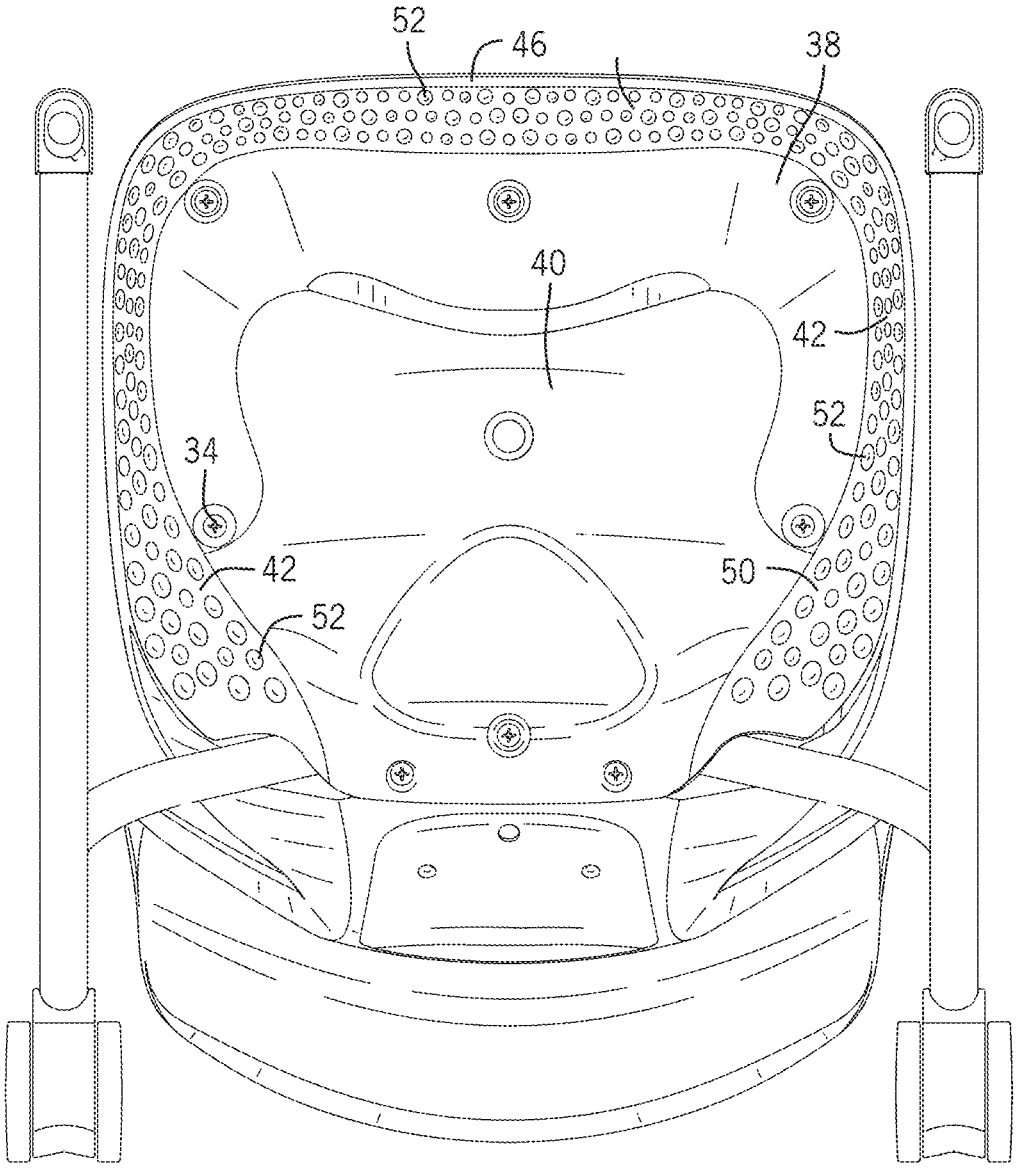
FIG. 4 is a bottom view showing the location of the sensory feature on the side surfaces and front surface of the seat shroud.

Referring now to FIGS. 3 and 4, the details of the seat shroud 38 will be further described. As shown in FIG. 3, the seat shroud 38 includes a generally flat center portion 40 that includes the series of openings 36. The center portion 40 is surrounded by a pair of side surfaces 42 and a front surface 44. Each of the side surfaces 42 and the front surface 44 slope upward from the center portion 40 to an upper edge 46 of the chair shroud 38, which can best be seen in FIG. 2. The upper edge 46 is designed to mate with the edge surface 48 of the seat 12 to form a smooth transition between the seat 12 and the seat shroud 38. As can be understood in FIG. 3, the entire seat shroud 38 is located below the seating surface 28 of the chair 10 and is thus only partially visible when the chair 10 is being used.

As can be understood in FIG. 1, when a seat occupant is positioned on the chair 10, the seat occupant is able to reach below the seating surface 28 and contact at least the side surfaces 42 and the front surface 44 of the seat shroud 38. Since the seat occupant is able to engage the at least these portions of the seat shroud when seated, the seat shroud 38 is designed in accordance with the present disclosure to include a sensory feature that is located along at least portions of the seat shroud, including at least portions of the pair of side surfaces 42 and the front surface 44. The sensory feature is designed to allow the seat occupant to fidget with the sensory feature when seated in the chair 10.

As described previously, sensory features can help individuals with autism manage sensory overload situations. It is contemplated that when an individual with autism is seated on the chair 10, the seat occupant with autism will be able to reach below the seating surface and engage and fidget with the sensory feature located on the seat shroud 38 in the locations that are easily accessible to the seat occupant. In the embodiment illustrated, the sensory feature includes features or elements that protrude from the otherwise smooth outer surface 50 that defines the side surfaces 42 and front surface 44 of the seat shroud 38. In other contemplated embodiments, the sensory feature could include features or elements that are recessed or indented from the otherwise smooth outer surface 50.

Figure 5:
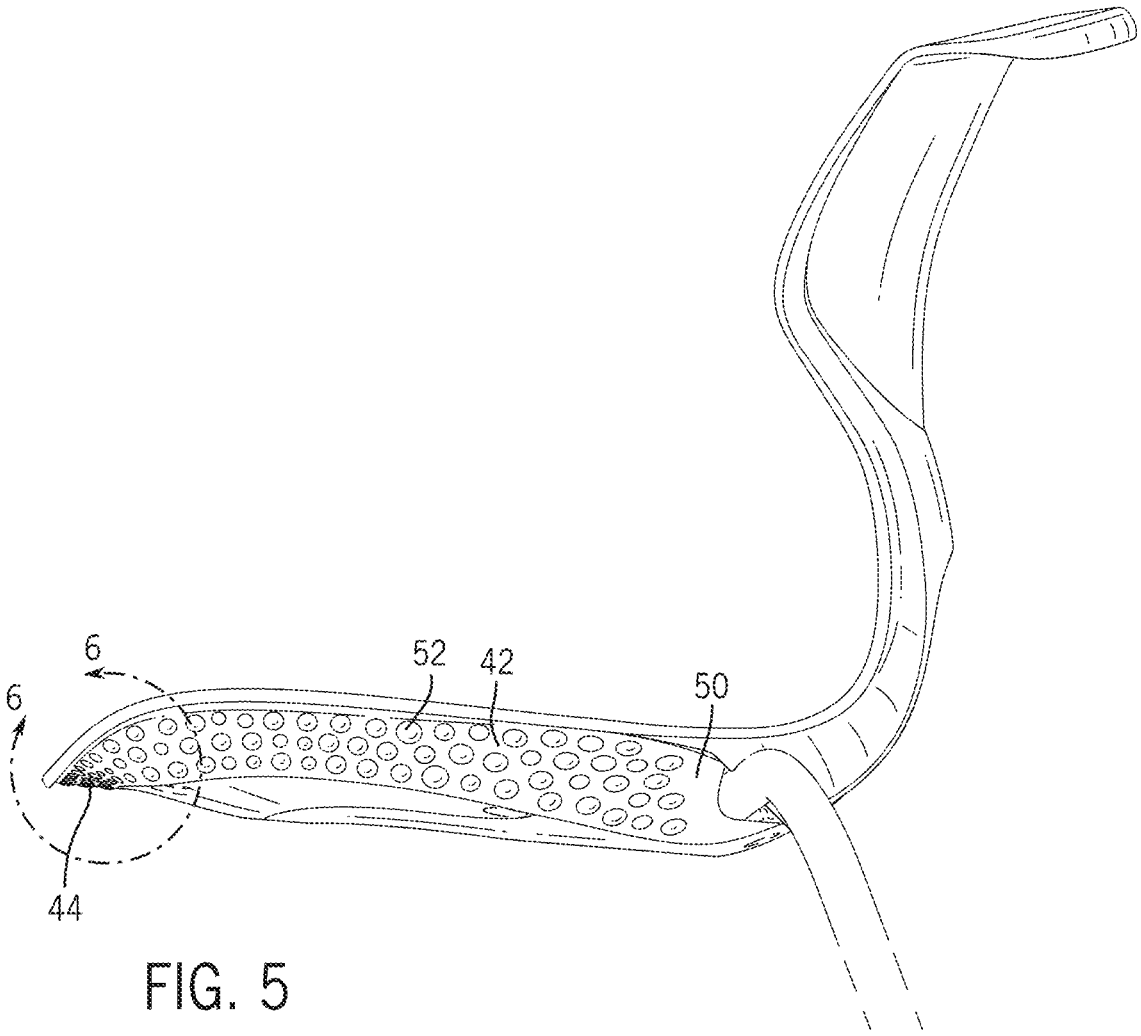
FIG. 5 is a side view of the chair showing the location of the sensory feature on one of the side surfaces of the seat shroud.
Figure 6:
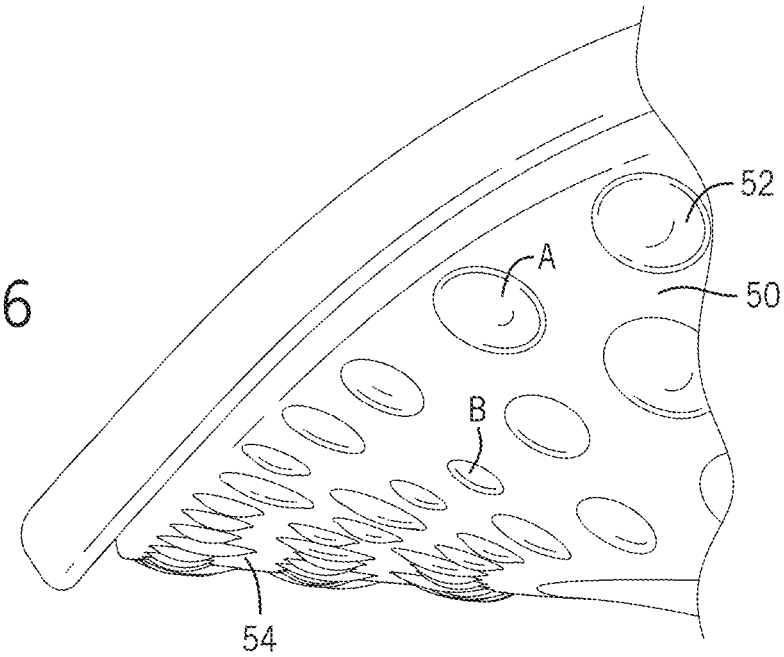
FIG. 6 is magnified view taken along line 9-9 of FIG. 2.

FIGS. 5 and 6 best illustrate the sensory feature that is included in accordance with one exemplary embodiment of the present disclosure. Although a specific type of sensory feature is shown in the illustrated embodiment, it should be understood that different types of sensory features could be utilized while operating within the scope of the present disclosure. As illustrated in FIGS. 5 and 6, the sensory feature of the present disclosure includes a plurality of sensory dots or domes 52. The sensory domes 52 are best shown in the magnified view of FIG. 6 as extending from the otherwise smooth outer surface 50 that is located between the sensory domes 52. Each of the sensory domes 52 includes a smooth, curved contact surface 54 that is designed to provide a smooth and desirable engagement surface for the fingers of a seat occupant. The individual sensory domes 52 are spaced throughout the entire pair of side surfaces 42 and over the entire front surface 44, as best shown in the view of FIG. 4. Although the sensory domes 52 are shown spaced throughout the entire surface of the side surfaces 42 and the front surface 44, it is contemplated that the sensory domes 52 could be located over less than all of the surface area in these areas, depending upon the specific configuration of the seat shroud.

As can be seen in the view of FIG. 4, the size of the individual sensory domes 52 can vary within each of the areas on the seat shroud 38 and can be randomly distributed throughout the surface area of the seat shroud 38 that includes the sensory feature. The variation in the size of the sensory domes 52 and the random distribution of the different sized sensory domes 52 provides part of the sensory feature that will aid in soothing the seat occupant as the seat occupant fidgets with the sensory feature. As shown in FIG. 6, sensory domes 52 of a first size A are intermixed with sensory domes of a second size B to provide what will appear to be a random distribution of the sensory domes. Although sensory domes 52 of two sizes A and B are shown, it is contemplated that more than two sizes of the sensory domes 52 could be included in the design of the present disclosure.

Referring back to bottom view of the seat shroud 38 FIG. 4, in one embodiment of the present disclosure, the size of the sensory domes 52 located on the front surface 44 will be smaller than the size of the sensory domes 52 located on the side surfaces 42. The variation in the sizing of the sensory domes 52 on the front surface 44 and the side surfaces 42 has been found to increase the fidgeting action of the seat occupant since the seat occupant will focus on the differences in the sizes during the fidgeting action. The differing sizes of sensory domes 52 in different locations along the seat shroud 38 will provide yet another variation in the sensory feature that will be appealing to the seat occupant. It is believed that varying the sizes of the sensory domes and the distribution of the different sized sensory domes throughout the contact surfaces of the seat shroud will further enhance the function of the sensory feature in soothing the seat occupant.

In the embodiment shown in FIGS. 3 and 4, each of the sensory domes 52 is molded into the seat shroud 38 during the creation of the seat shroud 38. Thus, each of the sensory domes 52 will be a permanent part of the seat shroud 38 and can be molded to have a smooth texture and what appears to be a random size distribution throughout the variety of surfaces areas. However, it is contemplated that in another embodiment, the sensory domes 52 could be included on support substrate that includes some type of adhesive included on the opposite, back surface. In such an alternate embodiment, the substrate including the sensory domes 52 can then be applied to the otherwise smooth outer surface of the side surfaces 42 and the front surface 44. The adhesive backed substrate can be applied to the seat shroud 38 after the seat shroud has been molded and assembled to the seat 12. Such an embodiment would allow the sensory feature to be added to an existing chair. Although adding a sensory feature to an existing chair is contemplated, in the preferred embodiment of the present disclosure, the sensory feature, and specifically the sensory domes 52, would be integrally molded with the seat shroud 38.

In the embodiment disclosed, the sensory feature is shown as the plurality of sensory domes 52. However, it is contemplated that other types of sensory features and shapes could be utilized. As an example, a series of spaced ridges or ribs, smooth block shapes or any other type of raised feature that can be engaged by a seat occupant could be utilized while operating within the scope of the present disclosure. In other embodiments, the sensory feature could be recessed or indented features that could also be engaged by the seat occupant when the seat occupant is seated in the chair of the present disclosure.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A chair for use by a seat occupant, the chair comprising:
- a seat for supporting the seat occupant;
- a chair back extending at an angle relative to the seat;
- a seat shroud located below the seat and having an outer surface that defines a pair of side surfaces and a front surface; and
- a sensory engagement feature located along at least a portion of the outer surface of the seat shroud,
- wherein the pair of side surfaces and the front surface of the seat shroud are accessible to the seat occupant and the sensory engagement feature is configured to be engaged by the seat occupant.

2. The chair of claim 1 wherein the sensory engagement feature includes a plurality of raised surfaces extending from the outer surface of the seat shroud.

3. The chair of claim 2 wherein each of the plurality of raised surfaces are partial round domes.

4. The chair of claim 1 wherein the seat and the chair back are monolithic and formed from molded plastic.

5. The chair of claim 1 wherein the seat shroud and the sensory engagement feature are monolithic and formed from molded plastic.

6. The chair of claim 1 wherein the sensory engagement feature protrudes from the outer surface of the seat shroud.

7. The chair of claim 1 wherein the seat has an edge surface and the front surface and the pair of side surfaces of the seat shroud mate with the edge surface of the seat, and wherein the sensory engagement feature is located on the front surface and the pair of side surfaces.

8. The chair of claim 7 wherein the sensory engagement feature includes a plurality of partial round domes.

9. The chair of claim 8 wherein the size of the partial round domes on the front surface are smaller than the size of the partial round domes on the pair of side surfaces.

10. A chair for use by a seat occupant, the chair comprising:
- a seat for supporting the seat occupant;
- a chair back integrally formed with the seat and extending at an angle relative to the seat;
- a leg assembly for supporting the seat and chair back;
- a seat shroud located below the seat and positioned to entrap the leg assembly between the seat shroud and the seat, the seat shroud including an outer surface that defines a front surface and a pair of side surfaces; and
- a sensory engagement feature located along at least a portion of the front surface and along at least a portion of each of the pair of side surfaces, wherein the sensory engagement feature protrudes outwardly from the outer surface of the seat shroud and is accessible to and configured to be directly engaged with by the seat occupant.

11. The chair of claim 10 wherein the sensory engagement feature includes a plurality of raised surfaces extending from the outer surface of the seat shroud.

12. The chair of claim 11 wherein each of the plurality of raised surfaces are partial round domes.

13. The chair of claim 12 wherein the size of the partial round domes on the front surface are smaller than the size of the partial round domes on the pair of side surfaces.

14. The chair of claim 10 wherein the seat shroud and the sensory engagement feature are monolithic.

15. The chair of claim 10 wherein the sensory engagement feature is applied to the outer surface of the seat shroud.

16. A chair for use by a seat occupant, the chair comprising:

a seat for supporting the seat occupant;

a chair back extending at an angle relative to the seat;

a leg assembly for supporting the seat and chair back;

a seat shroud located below the seat and positioned to entrap the leg assembly between the seat shroud and the seat, the seat shroud including an outer surface that defines a front surface and a pair of side surfaces; and a plurality of sensory domes extending from at least a portion of the front surface and at least a portion of each of the pair of side surfaces, wherein the sensory domes are accessible to the seat occupant and configured to be directly engaged with by the seat occupant.

17. The chair of claim 16 wherein the size of the sensory domes on the front surface are smaller than the size of the sensory domes on the pair of side surfaces.

18. The chair of claim 16 wherein the seat shroud and the plurality of sensory domes are integrally molded.

19. The chair of claim 16 wherein the sensory domes are applied to the seat shroud.

* * * * *